US006523284B1

(12) United States Patent
Clugston

(10) Patent No.: US 6,523,284 B1
(45) Date of Patent: Feb. 25, 2003

(54) MULTI-PURPOSE MATERIAL HANDLING APPARATUS

(76) Inventor: Scot J. Clugston, 27953 Whitcomb, Livonia, MI (US) 48154

( * ) Notice: Subject to any disclaimer, the term of this patent is extended or adjusted under 35 U.S.C. 154(b) by 0 days.

(21) Appl. No.: 09/764,961

(22) Filed: Jan. 18, 2001

Related U.S. Application Data

(60) Provisional application No. 60/182,361, filed on Feb. 14, 2000.

(51) Int. Cl.[7] ..... E02F 3/96

(52) U.S. Cl. ..... 37/403; 37/903; 172/250

(58) Field of Search ..... 37/403, 405, 406, 37/407, 409, 410, 461, 184, 185, 903; 414/724, 912; 172/817, 245, 250; 294/68.23

(56) References Cited

U.S. PATENT DOCUMENTS

| | | | | | |
|---|---|---|---|---|---|
| 1,205,425 | A | * | 11/1916 | Bernard | 37/184 |
| 1,762,946 | A | * | 6/1930 | Atkinson | 294/112 |
| 1,864,793 | A | * | 6/1932 | Botten | 37/184 |
| 2,594,763 | A | * | 4/1952 | Freyer | 37/184 |
| 2,828,038 | A | * | 3/1958 | Dorkins | 37/187 |
| 2,986,826 | A | * | 6/1961 | Timmons | 172/438 |
| 3,034,237 | A | * | 5/1962 | Wolfe et al. | 37/241 |
| 3,426,460 | A | * | 2/1969 | Hinkel et al. | 37/184 |
| 3,440,744 | A | * | 4/1969 | Smith | 37/404 |
| 3,469,330 | A | * | 9/1969 | Hood et al. | 37/404 |
| 3,471,950 | A | * | 10/1969 | Ferwerda | 37/403 |
| 3,767,075 | A | * | 10/1973 | Leverenz | 414/713 |
| 3,807,589 | A | * | 4/1974 | Shovick | 37/303 |
| 3,814,269 | A | * | 6/1974 | Blood et al. | 24/698.1 |
| 4,189,854 | A | * | 2/1980 | Haynes | 37/404 |
| 4,208,815 | A | * | 6/1980 | Yunker et al. | 37/446 |
| 4,360,980 | A | * | 11/1982 | Jarvis | 172/701.1 |
| 4,407,626 | A | | 10/1983 | Bruckner | |
| 4,550,512 | A | * | 11/1985 | Felstet | 172/701.3 |
| 4,566,844 | A | | 1/1986 | Campin | |
| 4,799,852 | A | | 1/1989 | Ramun | |
| 4,832,390 | A | * | 5/1989 | Cullen | 15/4 |
| 4,923,410 | A | | 5/1990 | Walters et al. | |
| 5,129,169 | A | * | 7/1992 | Aubichon | 172/817 |
| 5,315,772 | A | * | 5/1994 | Lalonde | 37/379 |
| 5,618,155 | A | * | 4/1997 | Tighe | 280/504 |
| 5,649,377 | A | | 7/1997 | Tanada | |
| 5,729,920 | A | | 3/1998 | Taylor | |
| 5,775,013 | A | * | 7/1998 | Von Schalscha | 172/701.3 |
| 5,819,445 | A | * | 10/1998 | LaBelle et al. | 172/817 |
| 5,918,389 | A | * | 7/1999 | Hall | 37/407 |
| 5,921,302 | A | * | 7/1999 | Petersen | 144/24.12 |
| 5,997,237 | A | | 12/1999 | Langenfeld et al. | |
| 6,088,938 | A | * | 7/2000 | Logan | 37/404 |
| 6,098,321 | A | * | 8/2000 | Logan | 37/403 |
| 6,237,257 | B1 | * | 5/2001 | Cronk, Jr. | 37/142.5 |
| 6,243,975 | B1 | * | 6/2001 | Gall | 37/407 |
| 6,360,458 | B2 | * | 3/2002 | Dolister | 37/195 |

FOREIGN PATENT DOCUMENTS

| | | | | |
|---|---|---|---|---|
| JP | 1163322 | * | 6/1989 | E02F/3/40 |

* cited by examiner

*Primary Examiner*—Thomas B. Will
*Assistant Examiner*—Kiristine Florio
(74) *Attorney, Agent, or Firm*—Harness, Dickey & Pierce, P.L.C.

(57) ABSTRACT

A multi-purpose material handling apparatus includes an adapter plate, a support arm extending from the adapter plate, an upper bucket fixedly attached to an end of the support arm, a lower bucket pivotally attached to the support arm, and an actuation mechanism for selectively pivoting the lower bucket relative to the upper bucket. Auxiliary tools may optionally be attached to either the upper or lower buckets for increased utility of the apparatus. Further, a plurality of hooks, apertures and arrangements are provided for insertion of various material-handling accessories.

83 Claims, 9 Drawing Sheets

MULTI-PURPOSE MATERIAL HANDLING APPARATUS

This application claims the benefit of Provisional application No. 60/182,361, filed Feb. 14, 2000.

FIELD OF THE INVENTION

The present invention generally relates to material-handling apparatuses and more specifically to hydraulically powered material-handling apparatuses having movable jaws that can load, grab, and/or demolish structures and associated material in construction and demolition work.

BACKGROUND OF THE INVENTION

Material-handling operations, such as bulldozing, grading, demolition, carrying, and grappling-type functions, necessitate different equipment and sometimes considerable manpower to perform. For example, the use of a bucket-type loader to demolish structures, uproot trees, and collect rubble is inefficient because conventional equipment is not versatile. Moreover, apparatuses used for grading, cutting, and backfilling have cumbersome structure and impaired operator field of vision that further complicate matters and raise costs.

While certain tractor-mounted bucket-loaders of the type having hydraulically powered, movable jaws are known, none employ versatility to increase overall efficiency and use. Not surprisingly, excavation, urban renewal, demolition, and land-clearing operations require the use of at least two different types of machines and often increased manpower to operate these machines. As such, there is a need in the industry for a machine capable of performing a wide variety of material-handling operations that would eliminate the necessity and expense of using multiple machines to complete these varied tasks. Further, there remains a need in the art for a material-handling apparatus that is adaptable for optimal economic and efficient use in both demolition- and earth-moving type operations, by way of non-limiting example. Moreover, an apparatus that can be modified through the use of various attachments to perform specific tasks is also desired.

SUMMARY OF THE INVENTION

Accordingly, the present invention provides a material handling apparatus for selective attachment to a vehicle. The material handling apparatus includes an adapter for selectively attaching the apparatus to the vehicle, a support arm extending from the adapter, an upper bucket fixedly attached to an end of the support arm and a lower bucket pivotally attached to the support arm. An actuation mechanism is further provided and is attached at a first end to one of the adapter and the support arm and at a second end to the lower bucket for selectively pivoting the lower bucket relative to the upper bucket. The actuation mechanism is preferably a hydraulic or pneumatic piston-cylinder that is interconnected with power lines for selectively driving the actuation mechanism.

The material handling apparatus preferably includes attachment features such as apertures, hooks and the like, for selective attachment of optional material handling devices. A plurality of auxiliary tools are further provided for selective attachment to or engagement with the material handling apparatus.

Other advantages of the invention will be readily appreciated as the same becomes better understood by reference to the following detailed description when considered in connection with the accompanying drawings.

DETAILED DESCRIPTION OF THE PREFERRED EMBODIMENT

Figure 1:
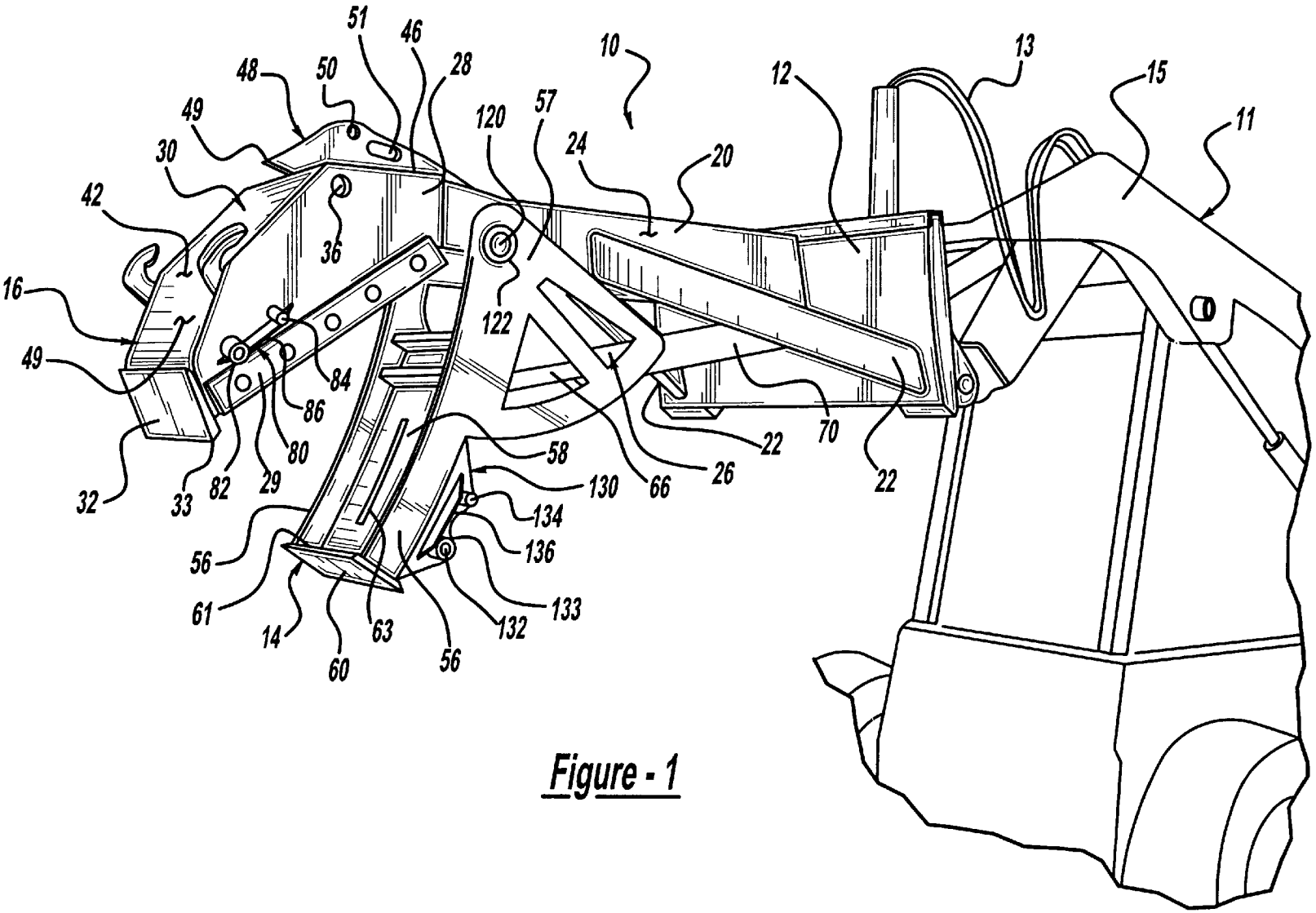
FIG. 1 is a schematic view of the multi-purpose material handling apparatus of the present invention in a partially open position.
Figure 2:
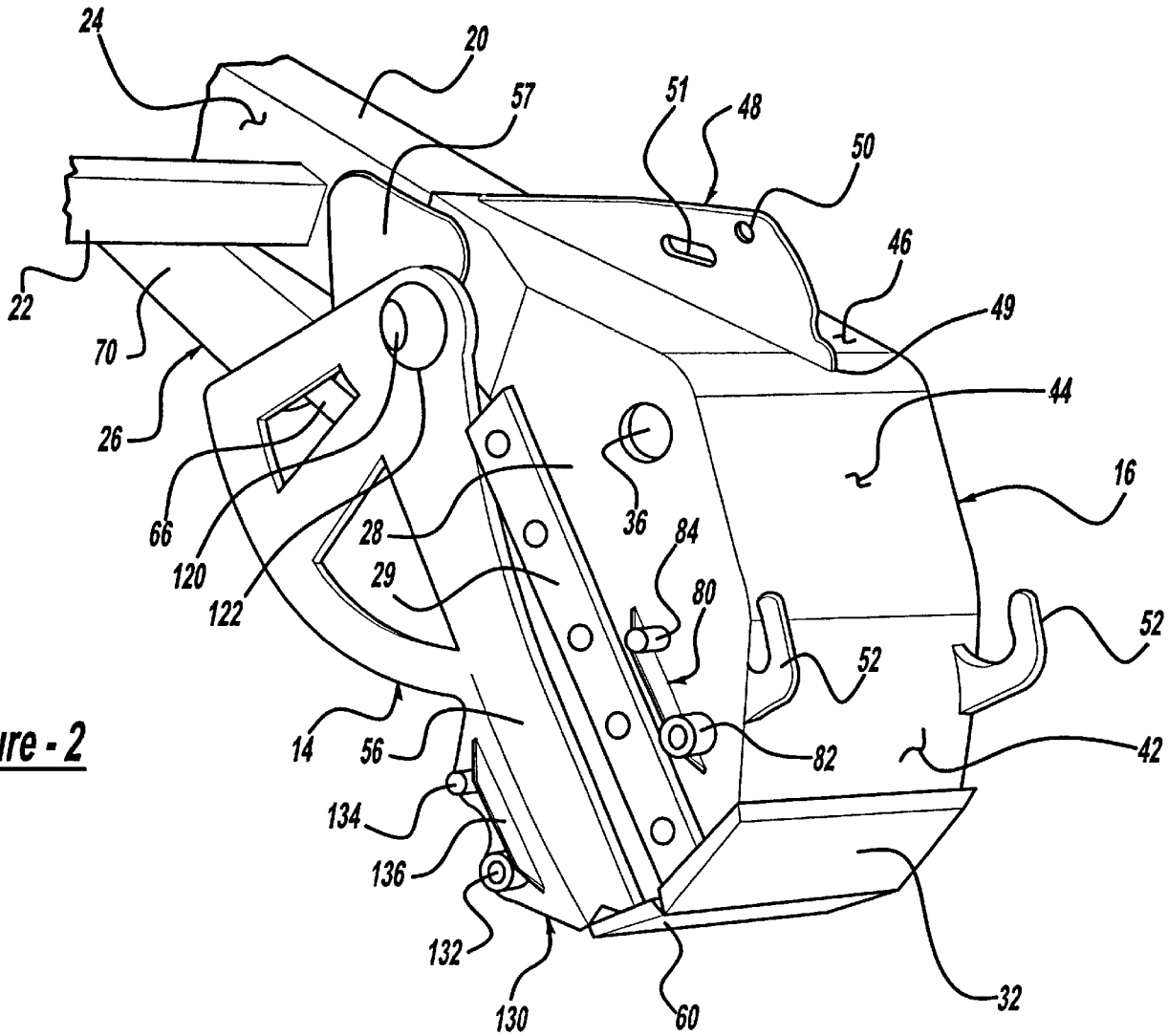
FIG. 2 is a schematic view of the multi-purpose material handling apparatus of the present invention in a closed position.

The present invention overcomes the deficiencies of prior material handling equipment by providing a multipurpose, articulated apparatus 10 useful for various tasks. The apparatus 10 is preferably mounted to hydraulic arms 15 of a conventional tract- or wheeled-type earth-working machine 11, such as a skidsteer, front-end loader, telescopic boom, or other like equipment, by a face-plate 12 or other adapting device. Power connections 13 between the machine 11 and the apparatus 10 permit an operator to control the movements of the apparatus 10. When mounted, the apparatus 10 can typically be made to move in any direction by the machine 11.

The apparatus 10 includes a lower jaw or bucket 14 that is pivotally connected relative to an upper jaw or bucket 16. The upper bucket 16 is mounted to the forward end of a structural arm 20. A pair of braces 22 extend angularly from an intermediate portion of opposite sides 24 of the arm 20 to the face-plate 12. A piston-cylinder assembly 26 is connected at one end thereof to the lower bucket 14 and at the other end thereof to the face-plate 12.

The upper bucket 16 includes a pair of laterally spaced side walls 28 rigidly secured to a reinforced top surface 30 and a blunt front surface 32 opposing a back 34, which is connected to the arm 20. The blunt front surface 32 includes an edge 33 that extends from the upper bucket 16 beyond side walls 28 for use in gripping or breaking material. The interior of the upper bucket 16 provides a volume for collecting, holding, and discharging material (not shown) alone or in combination with the lower bucket 14.

Each side wall 28 of the upper bucket 16 includes an aperture 36 generally disposed in an upper top corner thereof. Each aperture 36 preferably extends through the corresponding side wall 28 and is disposed such that the apertures 36 are coaxially aligned. The apertures 36 are adapted for mating insertion therein of a non-working part of various material-handling accessories, such as a battering ram (not shown), completely or partially through the upper bucket 16, whereby the working part of the accessory protrudes outwardly from either one or both of the side walls 28. Alternatively, each aperture 36 may extend only partially through the corresponding side wall 28. In this case, the non-working part of the accessory is matingly inserted into the aperture 36, and the working part of the accessory protrudes outwardly from the corresponding side wall 28.

A reinforcement rail 29 is bolted to and runs along the bottom edge of each side wall 28. Each side wall 28 further includes a mounting arrangement 80 including a tubular post 82 and a cylindrical post 84, each extending from the side wall 28. Preferably, a support plate 86 is disposed immediately below the tubular and cylindrical posts 82,84 and structurally reinforces each. The mounting arrangements 80 are used to selectively mount various material-handling accessories, as described hereinbelow.

Figure 3:
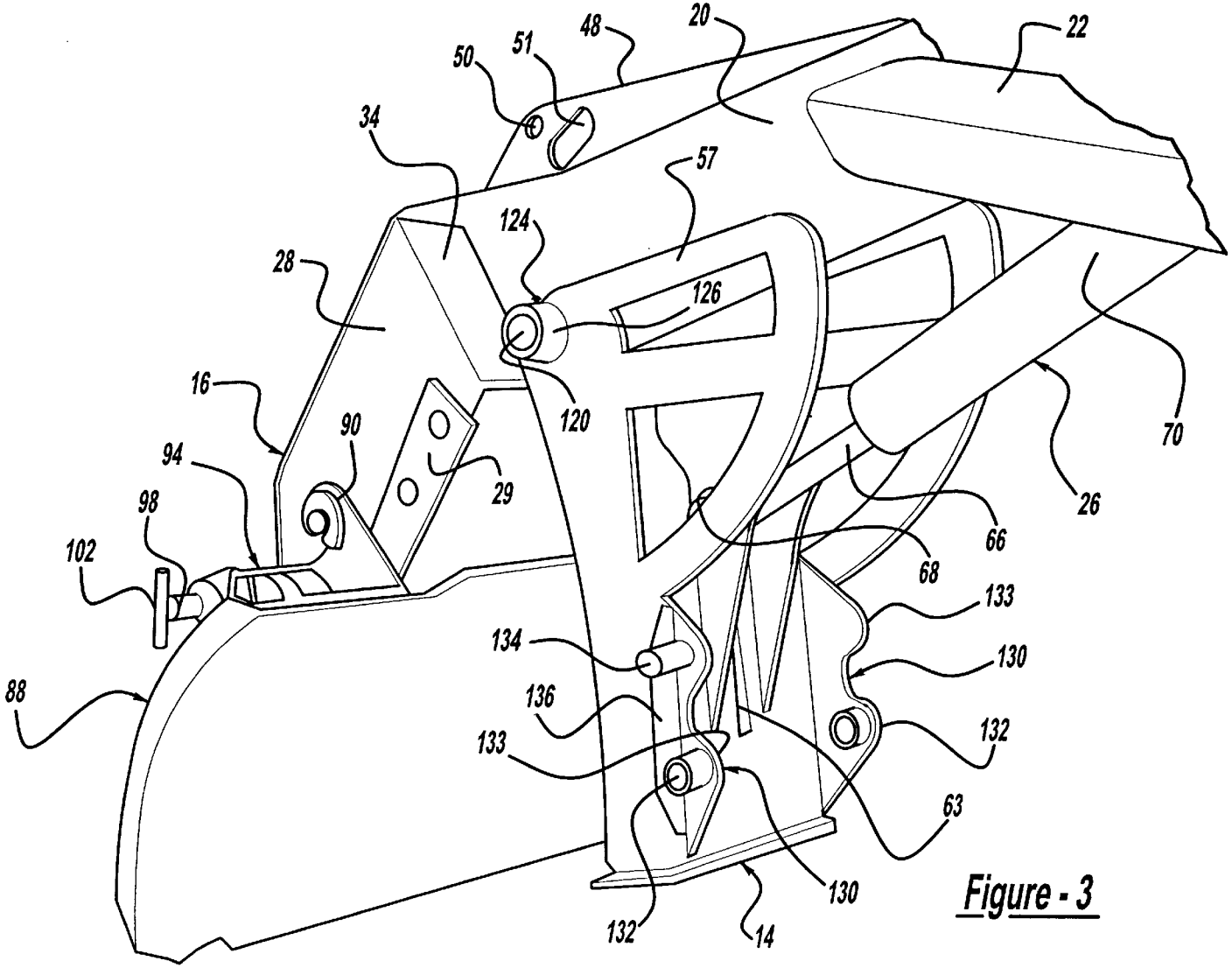
FIG. 3 is a schematic view of the multi-purpose material handling apparatus of the present invention having an auxiliary tool attached to an upper bucket.
Figure 4:
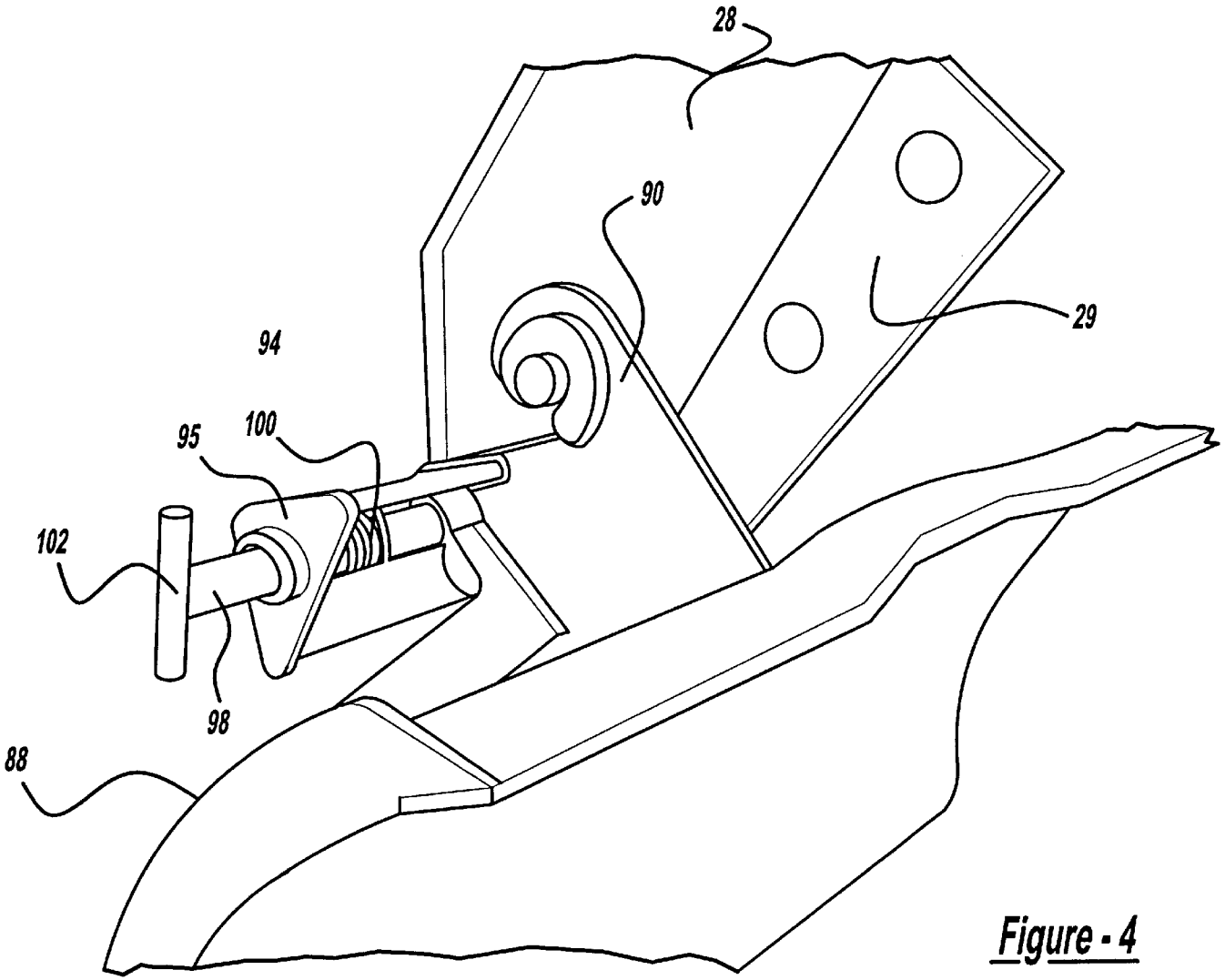
FIG. 4 is a detailed schematic view of the interconnection between the auxiliary tool and the multi-purpose material handling apparatus.
Figure 5:
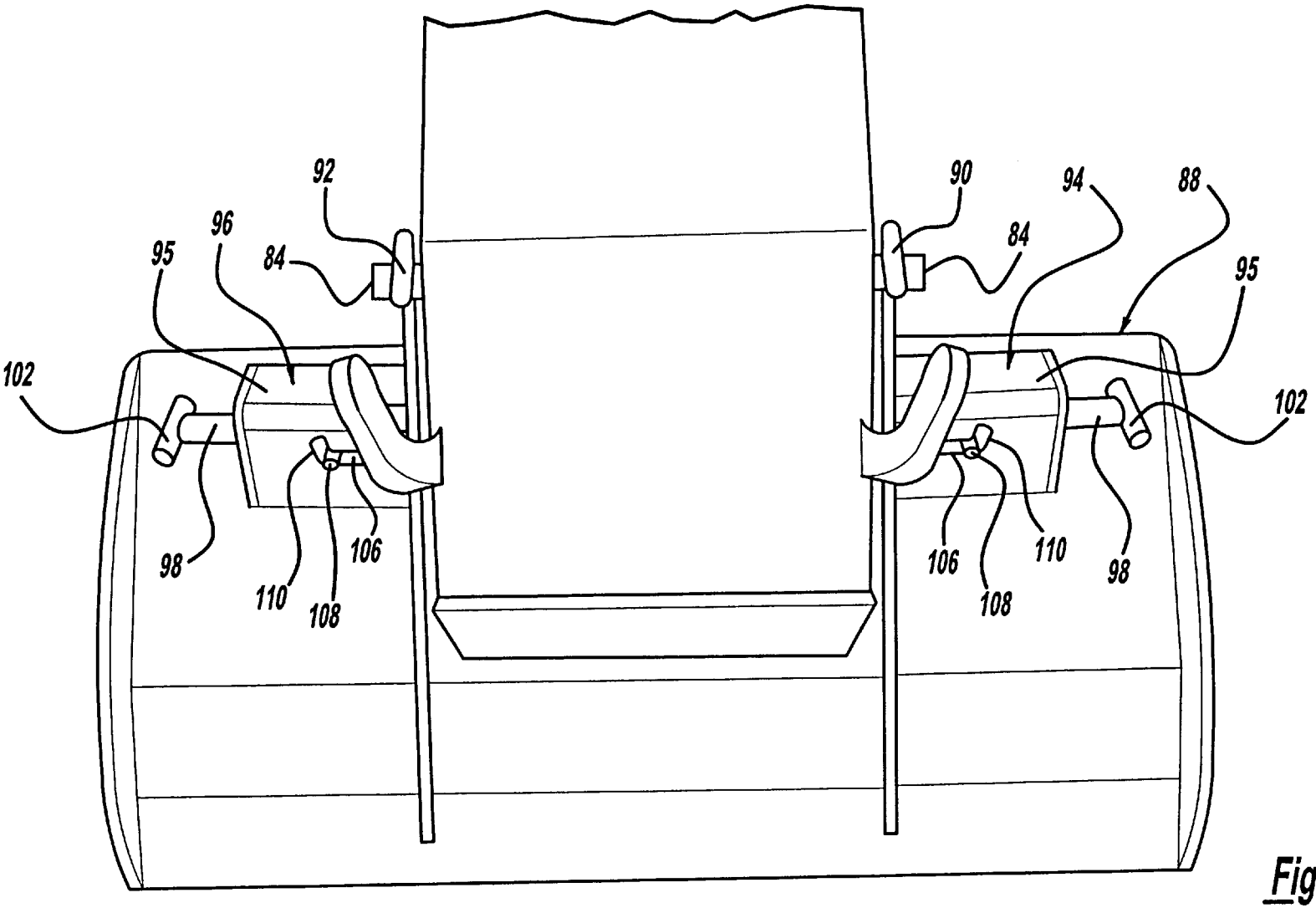
FIG. 5 is a front view of the multi-purpose material handling apparatus of the present invention with the auxiliary tool attached thereto.

With particular reference to FIGS. 3 through 5, a dozing blade 88 is shown operatively attached to the upper bucket 16. The dozing blade 88 includes first and second hooks 90,92 that receive the cylindrical posts 84 of the mounting arrangement 80. The dozing blade 88 further includes first and second lock mechanisms 94,96 for selectively locking the dozing blade 88 to the upper bucket 16. The lock mechanisms 94,96 each include a post 98 that is slidably supported within a housing 95 and is biased inward by a spring 100. The post 98 includes a handle 102 for pulling the post 98 against the biasing force of the spring 100. When the dozing blade 88 is coupled with the upper bucket 16, the post 98 seats within the tubular post 82 for locking the dozing blade 88 to the upper bucket 16. By pulling the post 98 against the biasing force of the spring 100, the post 98 may be unseated from the tubular post 82 for releasing the dozing blade 88 from engagement with the upper bucket 16.

To ease operation, the posts 98 may themselves be locked in an open position, against the biasing force of the spring 100. To achieve this, each lock mechanism 94,96 includes a slot 106 within the housing 95, through which a finger 108 of the post 98 slidably travels. An outside end 110 of each slot 106 curves at approximately 90° relative to the slot 106. By pulling sufficiently on the posts 98, the finger 108 slides far enough along the slot 106 to reach the curved outside end 110 of the slot 106. The post 98 is then rotated such that the finger 108 seats within the curved outside 110 end of the slot 106, wherein the post 98 is prohibited from inward travel.

The top surface 30 of the upper bucket 16 includes three planar surfaces 42,44,46 connected to form a generally concave outer surface. A cutting, ripping, demolition, and shearing device 48 extends outwardly from the planar surface 46 of the top surface 30 and is adapted for use in demolition to grip and remove pipe, conduit, beams, etc. The device 48 includes apertures 50,51 adapted for mating insertion therein of various material-handling accessories such that the accessory extends across the apparatus 10. The device 48 includes a point 49 that extends past the planar surface 44. The top surface 30 is also provided with a pair of hooking devices 52, adapted for lifting objects, projecting outwardly from planar surface 42 and disposed adjacent opposite edges of the planar surface 42.

As best seen in FIG. 1, the lower bucket 14 is pivotable to a closed position in substantial abutting relation to the upper bucket 16. The lower bucket 14 has two arcuate side walls 56 that are rigidly secured to a reinforced bottom 58 and a front wall 60, thereby providing a concave interior surface defining a lower bucket volume adapted for collecting, holding, and discharging material either alone or in combination with the upper bucket 16. The sidewalls 56 include a guard 57 to protect a piston rod 66 of the piston cylinder assembly 26. The front wall 60 of the lower bucket 14 is adapted to receive various replaceable gripping and shearing devices, such as a fang or a blade. A top edge 61 of the front wall 60 extends upward from the lower bucket 14 to facilitate the grappling and breaking of large objects.

The lower bucket 14 is pivotally attached to the arm 20 immediately behind the upper connection of the upper bucket 16 to the arm 20. A pin 120 extends through openings 122 in the lower bucket 14 and completely through the arm 20 for pivotally supporting the lower bucket 14. The pin 120 is preferably held in position by a set screw 124 disposed through a flange 126 located on one side of the lower bucket 14. The set screw 124 is screwed through the flange 126 to apply a force on the pin 120, prohibiting the pin 120 from sliding out of position.

Figure 8:
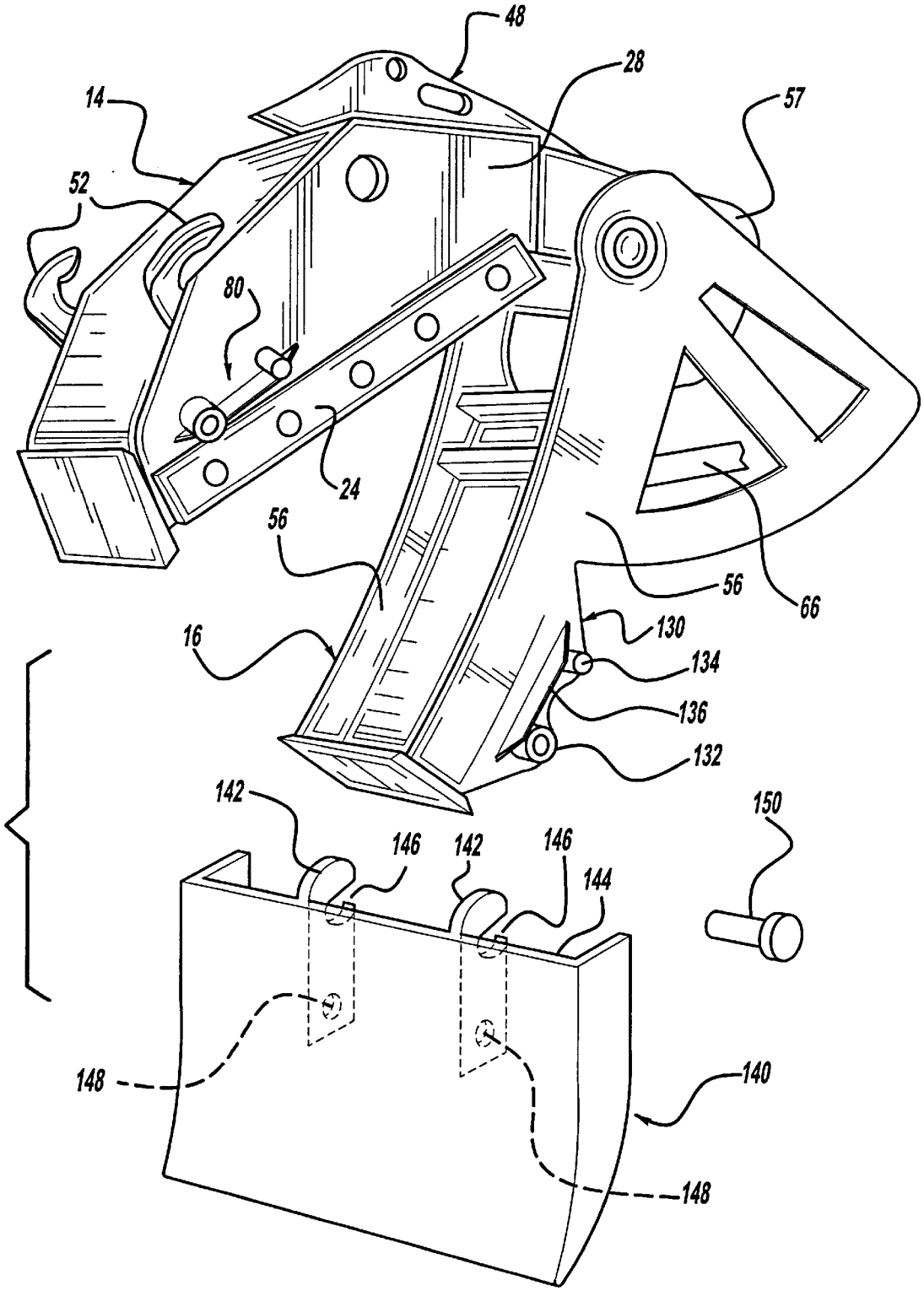
FIG. 8 is an exploded schematic view of the multi-purpose material handling apparatus of the present invention and an auxiliary tool for attachment to the lower bucket.

The lower bucket 14 further includes mounting arrangements 130 extending below each side wall 56, respectively. The mounting arrangements 130 are constructed similarly to the mounting arrangements 80 of the upper bucket 16. The mounting arrangements 130 each include a tubular post 132 adjacent a cylindrical post 134, and a support plate 136 disposed immediately above the posts 132, 134 to structurally reinforce each. The mounting arrangements 130 are used to selectively mount various material-handling accessories, such as a dozing blade 140, as best seen in FIG. 8.

The dozing blade 140 is selectively attachable to the lower bucket 14 in a similar manner as attachment to the upper bucket 16. The dozing blade 140 includes a pair of parallel plates 142 extending from a back face 144. Each plate 142 includes a hook slot 146 and a hole 148. The cylindrical posts 134 of the mounting arrangements 130 are received into the hook slots 146 and the holes 148 are aligned with the tubular posts 132. Pins 150 are provided to secure the dozing blade 140 to the lower bucket 14 by inserting each pin 150 through the hole 148 and within the tubular post 132. Alternatively, the pin 150 may be a bolt that interfaces with an optional threaded portion of the tubular post 132. Or, other methods known in the art may be implemented to secure the pin 150 within the tubular post 132, such as a set screw or cotter-pin arrangement.

As described above, the mounting arrangements 130 extend a distance below the lower bucket 14. Disposed as such, a bottom surface 133 of the mounting arrangements 130 provides a pivot surface for the apparatus 10, relative to the ground. In a particular operation, increased leverage may be required. Therefore, the mounting arrangements 130 enable the apparatus 10 to pivot on the bottom surfaces 133 relative to the ground, thus providing increased leverage.

In a first exemplary embodiment, the piston-cylinder assembly 26 is hydraulic and connected at the end of a piston rod 66 by a pin assembly 68 (see FIG. 3) to the lower, rearward portion of the lower bucket 14 and extends upwardly therefrom to connect at the end of a piston cylinder 70 to the face-plate 12. Actuation of the piston-cylinder assembly 26 provides for reciprocal motion of the piston-cylinder assembly 26 and is controlled by the supply of fluid under pressure directed through connections 13 communicating with the rear of the cylinder 70. Such supply acts to extend the rod 66 outwardly from the cylinder 70 to provide for pivotal movement of the lower bucket 14 relative to the upper bucket 16 about the pivot pin 120. It is also foreseen that the hydraulic piston-cylinder assembly 26 may alternatively be substituted with a pneumatic piston-cylinder assembly operating essentially in the same manner.

Figure 9:
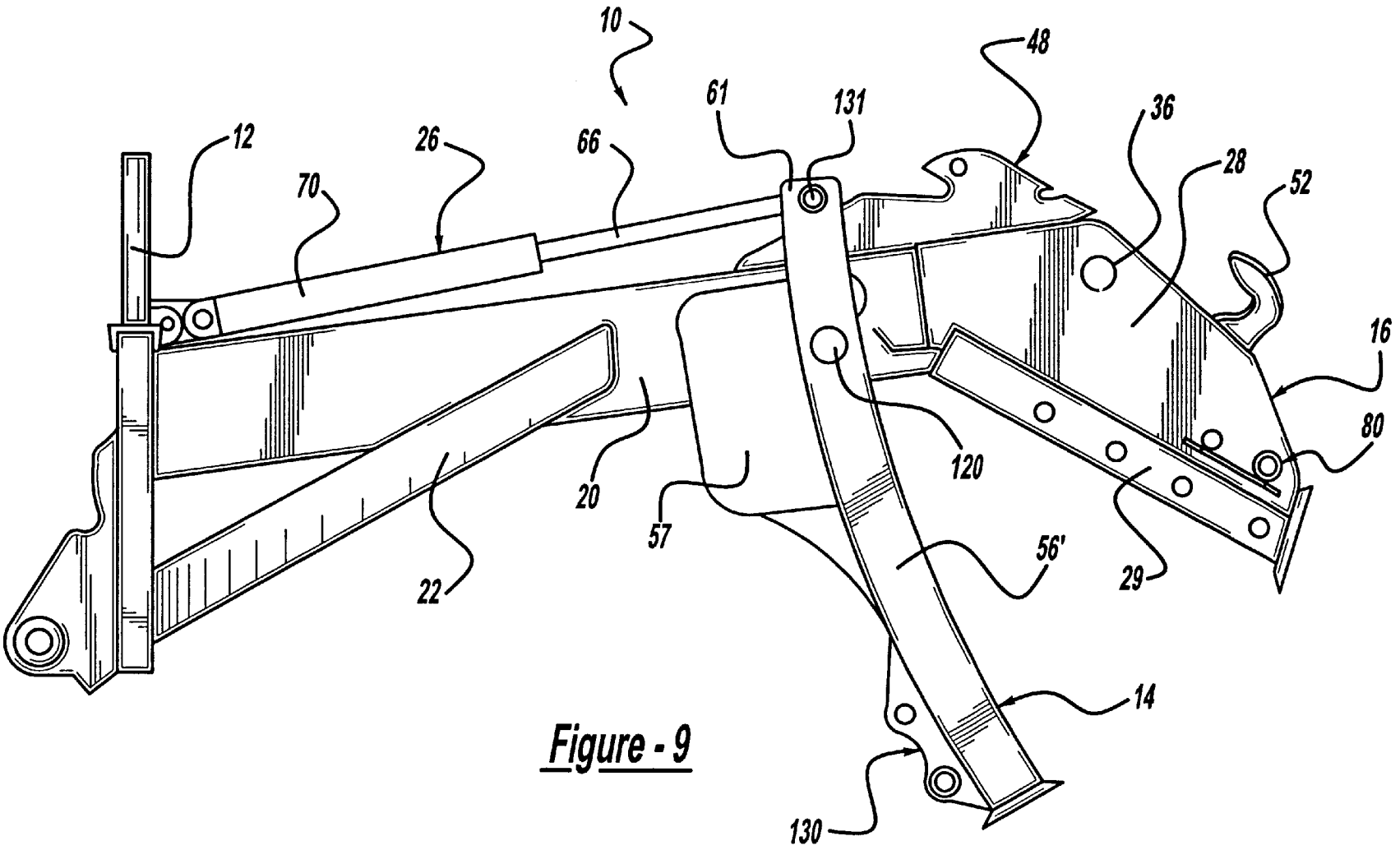
FIG. 9 is a side view of the multi-purpose material handling apparatus according to a second preferred embodiment of the present invention.

In a second exemplary embodiment the side walls 56' extend upwardly past the pivot connection between the arm 20 and the lower bucket 14. As shown in FIG. 9, the hydraulic piston-cylinder assembly 26 is connected by the piston rod 66 through a pin assembly 131 to the extended distal ends 59 of the side walls 56, and by the piston cylinder 70 to the face-plate 12. Therefore, the piston-cylinder assembly 26 is generally disposed above the arm 20.

In operation, the relative position of the lower bucket 14 with respect to the upper bucket 16 can be selectively controlled by the piston-cylinder assembly 26 so that the buckets 14,16 are open, closed, or at any position therebetween with respect to each other. Such an articulated design, in combination with the machine to which the apparatus 10 is attached, makes the apparatus 10 highly flexible.

By controlling the relative positions of the buckets 14,16, the device may be used in clamshell operations that require grappling of loose materials, such as tree trunks, building rubble, steel beams, and the like, in addition to loading and dumping of loose materials. Furthermore, the buckets 14,16 are suitable for use in bulldozing operations by completely closing the buckets 14,16 with respect to each other. The apparatus 10 can also be used for conventional front-end loading and excavating operations without the need to remove either bucket 14,16 from the assembly.

Figure 6:
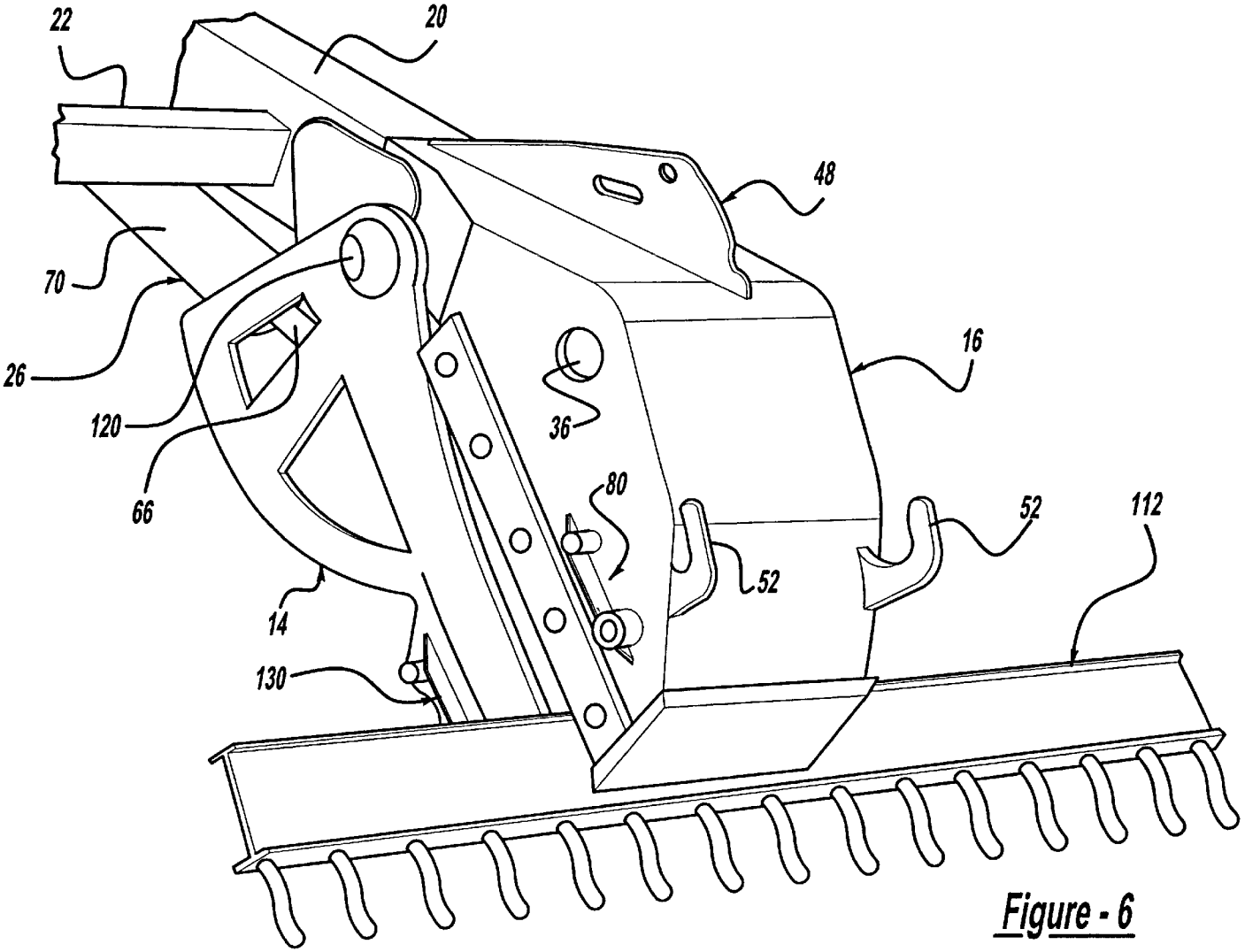
FIG. 6 is a schematic view of the multi-purpose material handling apparatus of the present invention gripping an alternative auxiliary tool.
Figure 7:
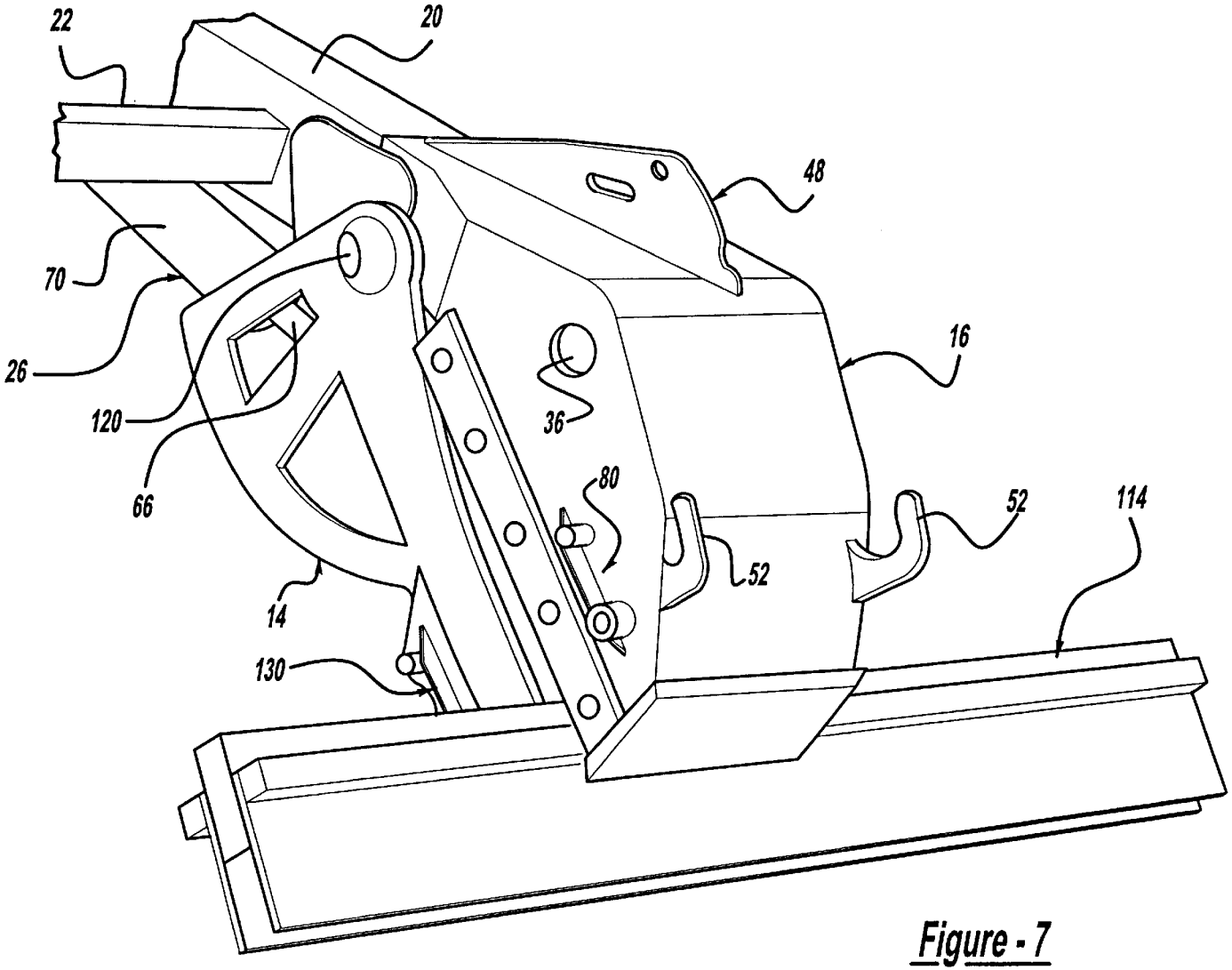
FIG. 7 is a schematic view of the multi-purpose material handling apparatus of the present invention gripping yet another alternative auxiliary tool.

Insertion of various material-handling accessories into any or all of the apertures 36,50,51, holes 54, and openings 64 allows the apparatus 10 to perform a multitude of material-handling operations at any given time. The versatility of the apparatus 10 permits an operator to complete a multi-faceted task without having to leave the controls. As shown in FIGS. 6 and 7, the apparatus 10 may grapple auxiliary tools such as earth-working devices including, but not limited to, a rake 112, a grade 114 or the like. The apparatus 10 may be manipulated by an operator to further manipulate material, such as dirt or rock, by either auxiliary tool.

As can be seen, the present invention overcomes the deficiencies in the related art in a multi-purpose material handling apparatus. The apparatus 10 is durable and more flexible and versatile and, thus, is adaptable for optimal economic and efficient use in construction, demolition, and earth-moving operations. Furthermore, the apparatus 10 performs more operations at any one time and does not require disassembly of parts therefrom for performance of such operations.

The invention has been described in an illustrative manner. It is to be understood that the terminology which has been used is intended to be in the nature of words of description rather than of limitation. Many modifications and variations of the invention are possible in light of the above teachings. Therefore, the invention may be practiced other than as specifically described.

What is claimed is:

1. A material handling apparatus for selective attachment to a vehicle, the apparatus comprising:

an adapter for selectively attaching said apparatus to said vehicle;

a support arm extending from said adapter and terminating at a distal end;

an upper bucket fixedly attached to said distal end of said support arm;

a lower bucket pivotally attached to said support arm between said adapter and said distal end; and an actuation mechanism attached at a first end to one of said adapter and said support arm and at a second end to said lower bucket for selectively pivoting said lower bucket relative to said upper bucket.

2. The material handling apparatus of claim 1, further comprising an earth-moving apparatus selectively attachable to said upper bucket.

3. The material handling apparatus of claim 2, wherein said earth-moving apparatus includes a dozing blade.

4. The material handling apparatus of claim 1, further comprising an earth-moving apparatus selectively attachable to said lower bucket.

5. The material handling apparatus of claim 4, wherein said earth-moving apparatus includes a dozing blade.

6. The material handling apparatus of claim 1, further comprising at least one support strut for structurally supporting said support arm relative to said adapter.

7. The material handling apparatus of claim 1, wherein said upper bucket includes an upper plate, first and second side plates extending from said upper plate and front and back plates extending from said upper plate and joined with said first and second side plates.

8. The material handling apparatus of claim 7, wherein said upper plate comprises a plurality of plates attached to one another along respective edges.

9. The material handling apparatus of claim 7, wherein said upper bucket further includes first and second reinforcing rails fixedly attached along a bottom edge of each of said side plates.

10. The material handling apparatus of claim 1, wherein said upper bucket includes a first material manipulation member extending from a top face of said upper bucket.

11. The material handling apparatus of claim 10, wherein said first material manipulation member comprises a plate fixedly attached to said upper bucket along a first edge of said plate and said plate having a first end generally shaped in a sharp point.

12. The material handling apparatus of claim 11, wherein said plate includes at least one aperture therethrough.

13. The material handling apparatus of claim 7, wherein said front plate extends past bottom edges of said side plates for forming a second material manipulation member.

14. The material handling apparatus of claim 7, wherein each of said side plates includes an aperture therethrough.

15. The material handling apparatus of claim 1, further comprising at least one hook extending from a top surface of said upper bucket.

16. The material handling apparatus of claim 2, further comprising a first mounting arrangement disposed on a first side of said upper bucket and a second mounting arrangement disposed on a second side of said upper bucket for selective attachment of said earth-moving apparatus.

17. The material handling apparatus of claim 16, wherein said earth-moving apparatus includes first and second hooks and first and second adjustable pins for selectively attaching said earth-moving apparatus to said first and second mounting arrangements.

18. The material handling apparatus of claim 1, wherein said lower bucket includes a bottom plate, first and second side plates extending from said bottom plate and a front plate extending from said bottom plate and joined with said first and second side plates.

19. The material handling apparatus of claim 18, wherein said first and second side plates extend past said lower bucket forming first and second pivot arms pivotally attached to said support arm.

20. The material handling apparatus of claim 19, wherein said actuation mechanism is pivotally attached to said lower bucket generally between said first and second pivot arms.

21. The material handling apparatus of claim 4, further comprising a first mounting arrangement disposed on a first side of said lower bucket and a second mounting arrangement disposed on a second side of said lower bucket for selective attachment of said earth-moving apparatus.

22. The material handling apparatus of claim 21, wherein said earth-moving apparatus includes first and second aperture sets for receiving a plurality of mounting pins therethrough for selectively attaching said earth-moving apparatus to said first and second mounting arrangements.

23. The material handling apparatus of claim 1, further including an auxiliary tool receivable between and holdable by said upper and lower buckets such that said material handling apparatus selectively manipulates said auxiliary tool.

24. The material handling apparatus of claim 23, wherein said auxiliary tool includes a rake.

25. The material handling apparatus of claim 23, wherein said auxiliary tool includes a grader.

26. The material handling apparatus of claim 23, wherein said actuation mechanism is a hydraulic piston-cylinder mechanism.

27. The material handling apparatus of claim 26, wherein said actuation mechanism is selectively interconnected with a source of pressurized hydraulic fluid.

28. The material handling apparatus of claim 1, wherein said actuation mechanism is a pneumatic piston-cylinder mechanism.

29. The material handling apparatus of claim 28, wherein said actuation mechanism is selectively interconnected with a source of pressurized air.

30. A material handling apparatus for selective attachment to a vehicle, the apparatus comprising:

an adapter for selectively attaching said device to said vehicle;

a support arm extending from said adapter and terminating at a distal end;

an upper bucket fixedly attached to said distal end of said support arm, said upper bucket including a mounting arrangement for selectively mounting an auxiliary tool thereon;

a lower bucket pivotally attached to said support arm between said adapter and said distal end; and an actuation mechanism attached at a first end to one of said adapter or said support arm and at a second end to said lower bucket for selectively pivoting said lower bucket relative to said upper bucket.

31. The material handling apparatus of claim 30, wherein said auxiliary tool includes a dozing blade.

32. The material handling apparatus of claim 30, further comprising a second auxiliary tool selectively attachable to said lower bucket.

33. The material handling apparatus of claim 32, wherein said second auxiliary tool includes a dozing blade.

34. The material handling apparatus of claim 30, further comprising at least one support strut for structurally supporting said support arm relative to said adapter.

35. The material handling apparatus of claim 30, wherein said upper bucket includes an upper plate, first and second side plates extending from said upper plate and front and back plates extending from said upper plate and joined with said first and second side plates.

36. The material handling apparatus of claim 35, wherein said upper plate comprises a plurality of plates attached to one another along respective edges.

37. The material handling apparatus of claim 35, wherein said upper bucket further includes first and second reinforcing rails fixedly attached along a bottom edge of each of said side plates.

38. The material handling apparatus of claim 30, wherein said upper bucket includes a first material manipulation member extending from a top face of said upper bucket.

39. The material handling apparatus of claim 38, wherein said first material manipulation member comprises a plate fixedly attached to said upper bucket along a first edge of said plate and said plate having a first end generally shaped in a sharp point.

40. The material handling apparatus of claim 39, wherein said plate includes at least one aperture therethrough.

41. The material handling apparatus of claim 35, wherein said front plate extends past bottom edges of said side plates for forming a second material manipulation member.

42. The material handling apparatus of claim 35, wherein each of said side plates includes an aperture therethrough.

43. The material handling apparatus of claim 30, further comprising at least one hook extending from a top surface of said upper bucket.

44. The material handling apparatus of claim 30, wherein said auxiliary tool includes first and second hooks and first and second mounting pins for selectively attaching said auxiliary tool to said mounting arrangement.

45. The material handling apparatus of claim 30, wherein said lower bucket includes a bottom plate, first and second side plates extending from said bottom plate and a front plate extending from said bottom plate and joined with said first and second side plates.

46. The material handling apparatus of claim 45, wherein said first and second side plates extend past said lower bucket forming first and second pivot arms pivotally attached to said support arm.

47. The material handling apparatus of claim 46 wherein said actuation mechanism is pivotally attached to said lower bucket generally between said first and second pivot arms.

48. The material handling apparatus of claim 32, wherein said lower bucket further includes a mounting arrangement for selective attachment of said second auxiliary tool.

49. The material handling apparatus of claim 32, wherein said second auxiliary tool includes first and second aperture sets for receiving a plurality of mounting pins therethrough for selectively attaching said second auxiliary tool to said mounting arrangement.

50. The material handling apparatus of claim 30, further including a second auxiliary tool receivable between and holdable by said upper and lower buckets such that said material handling apparatus selectively manipulates said second auxiliary tool.

51. The material handling apparatus of claim 50, wherein said second auxiliary tool includes a rake.

52. The material handling apparatus of claim 50, wherein said second auxiliary tool includes a grader.

53. The material handling apparatus of claim 30, wherein said actuation mechanism is hydraulic piston-cylinder mechanism.

54. The material handling apparatus of claim 53, wherein said actuation mechanism is selectively interconnected with a source of pressurized hydraulic fluid.

55. The material handling apparatus of claim 30, wherein said actuation mechanism is a pneumatic piston-cylinder mechanism.

56. The material handling apparatus of claim 55, wherein said actuation mechanism is selectively interconnected with a source of pressurized air.

57. A material handling apparatus for selective attachment to a vehicle, the apparatus comprising:

an adapter for selectively attaching said device to said vehicle;

a support arm extending from said adapter and terminating at a distal end;

an upper bucket fixedly attached to said distal end of said support arm;

a lower bucket pivotally attached to said support arm between said adapter and said distal end, said lower bucket induding a mounting arrangement for selectively mounting an auxiliary tool thereon; and an actuation mechanism attached at a first end to one of said adapter or said support arm and at a second end to said lower bucket for selectively pivoting said lower bucket relative to said upper bucket.

58. The material handling apparatus of claim 57, wherein said auxiliary tool includes a dozing blade.

59. The material handling apparatus of claim 57, further comprising a second auxiliary tool selectively attachable to said upper bucket.

60. The material handling apparatus of claim 59, wherein said second auxiliary tool includes a dozing blade.

61. The material handling apparatus of claim 57, further comprising at least one support strut for structurally supporting said support arm relative to said adapter.

62. The material handling apparatus of claim 57, wherein said upper bucket includes an upper plate, first and second side plates extending from said upper plate and front and back plates extending from said upper plate and joined with said first and second side plates.

63. The material handling apparatus of claim 62, wherein said upper plate comprises a plurality of plates attached to one another along respective edges.

64. The material handling apparatus of claim 62, wherein said upper bucket further includes first and second reinforcing rails running along and fixedly attached to a bottom edge of each of said side plates.

65. The material handling apparatus of claim 57, wherein said upper bucket includes a first material manipulation member extending from a top face of said upper bucket.

66. The material handling apparatus of claim 65, wherein said first material manipulation member comprises a plate fixedly attached to said upper bucket along a first edge of said plate and said plate having a first end generally shaped in a sharp point.

67. The material handling apparatus of claim 66, wherein said plate includes at least one aperture therethrough.

68. The material handling apparatus of claim 62, wherein said front plate extends past bottom edges of said side plates for forming a second material manipulation member.

69. The material handling apparatus of claim 62, wherein each of said side plates includes an aperture therethrough.

70. The material handling apparatus of claim 57, further comprising at least one hook extending from a top surface of said upper bucket.

71. The material handling apparatus of claim 58, wherein said auxiliary tool includes first and second aperture sets for receiving a plurality of mounting pins therethrough for selectively attaching said second auxiliary tool to said mounting arrangement.

72. The material handling apparatus of claim 59, wherein said lower bucket includes a bottom plate, first and second side plates extending from said bottom plate and a front plate extending from said bottom plate and joined with said first and second side plates.

73. The material handling apparatus of claim 72, wherein said first and second side plates extend past said lower bucket forming first and second pivot arms pivotally attached to said support arm.

74. The material handling apparatus of claim 73, wherein said actuation mechanism is pivotally attached to said lower bucket generally between said first and second pivot arms.

75. The material handling apparatus of claim 59, wherein said upper bucket further comprises a mounting arrangement for selective attachment of said second auxiliary tool.

76. The material handling apparatus of claim 75, wherein said second auxiliary tool includes first and second hooks and first and second pins for selectively attaching said auxiliary tool to said mounting arrangement.

77. The material handling apparatus of claim 57, further including a second auxiliary tool receivable between and holdable by said upper and lower buckets such that said material handling apparatus selectively manipulates said auxiliary tool.

78. The material handling apparatus of claim 77, wherein said second auxiliary tool includes a rake.

79. The material handling apparatus of claim 77, wherein said second auxiliary tool includes a grader.

80. The material handling apparatus of claim 57, wherein said actuation mechanism is a hydraulic piston-cylinder mechanism.

81. The material handling apparatus of claim 80, wherein said actuation mechanism is selectively interconnected with a source of pressurized hydraulic fluid.

82. The material handling apparatus of claim 57, wherein said actuation mechanism is a pneumatic piston-cylinder mechanism.

83. The material handling apparatus of claim 82, wherein said actuation mechanism is selectively interconnected with a source of pressurized air.

* * * * *